US010398285B2

(12) United States Patent
Blackman

(10) Patent No.: US 10,398,285 B2
(45) Date of Patent: Sep. 3, 2019

(54) STATIONARY RACK ATTACHABLE TO A CLOTHES DRYER

(71) Applicant: Jason E. Blackman, McDonough, GA (US)

(72) Inventor: Jason E. Blackman, McDonough, GA (US)

( * ) Notice: Subject to any disclaimer, the term of this patent is extended or adjusted under 35 U.S.C. 154(b) by 90 days.

(21) Appl. No.: 15/932,029

(22) Filed: Jan. 26, 2018

(65) Prior Publication Data

US 2019/0231165 A1 Aug. 1, 2019

(51) Int. Cl.

| | |
|---|---|
| ***A47L 23/20*** | (2006.01) |
| ***D06F 58/20*** | (2006.01) |
| ***D06F 58/02*** | (2006.01) |

(52) U.S. Cl.

CPC ..... *A47L 23/205* (2013.01); *D06F 58/02* (2013.01); *D06F 58/20* (2013.01)

(58) Field of Classification Search

CPC ..... D06F 58/02; D06F 58/20; D06F 58/24; D06F 58/22; A47L 23/205

USPC ..... 34/91, 595–610

See application file for complete search history.

(56) References Cited

U.S. PATENT DOCUMENTS

| | | | | | |
|---|---|---|---|---|---|
| 1,767,157 | A * | 6/1930 | Steele | D06F 58/10 | 312/245 |
| 2,272,524 | A * | 2/1942 | Johnson | D06F 1/12 | 211/181.1 |
| 3,344,532 | A * | 10/1967 | Bigler | D06F 58/04 | 34/600 |
| 4,091,548 | A * | 5/1978 | Daily | D06F 58/04 | 312/311 |
| 4,908,959 | A * | 3/1990 | Kretchman | D06F 58/04 | 34/104 |
| 5,743,025 | A * | 4/1998 | Jordan, Jr. | D06F 58/04 | 34/600 |
| 6,026,592 | A * | 2/2000 | Herr | D06F 58/04 | 34/446 |
| 7,228,646 | B1 * | 6/2007 | Purcell | D06F 58/04 | 34/104 |
| 7,591,082 | B2 * | 9/2009 | Lee | D06F 58/04 | 34/237 |

(Continued)

FOREIGN PATENT DOCUMENTS

| | | | | |
|---|---|---|---|---|
| CA | 2568664 A1 * | 6/2007 | ..... | D06F 29/00 |
| EP | 1777334 A2 * | 4/2007 | ..... | D06F 58/04 |
| KR | 20070043164 A * | 4/2007 | ..... | D06F 58/04 |

*Primary Examiner* — Stephen M Gravini

(74) *Attorney, Agent, or Firm* — Harry I. Leon; Vivian L. Steadman

(57) ABSTRACT

A drying rack easily attachable to, as well as readily removable from, the interior, stationary rear wall of a tumble-type, clothes dryer, for drying boots or similar objects in minutes and without their being tossed about. Supporting such objects placed on the drying rack's wire frame shelf and the shelf itself in such a way that it extends generally horizontally away from the rear wall is a pair of hinged, opposable side rails, each having an elongated arm that ends in a hook. By utilizing the flexibility afforded by the hinged connections between the side rails and the shelf, one can quickly suspend the drying rack from the rear wall by simply hooking the elongated arms onto a pair of air flow duct-covering grids commonly found there or, alternately, onto a 0.25 inch hole or pair of holes drilled into the rear wall in place of the grid(s).

7 Claims, 3 Drawing Sheets

(56) References Cited

U.S. PATENT DOCUMENTS

| | | | | |
|---|---|---|---|---|
| 7,913,419 | B2 * | 3/2011 | Tomasi | D06F 29/00 211/85.3 |
| 8,015,727 | B2 * | 9/2011 | Lee | D06F 58/04 156/111 |
| 8,087,184 | B2 * | 1/2012 | Banta | D06F 58/04 34/600 |
| 8,347,523 | B2 * | 1/2013 | Chung | D06F 58/04 34/130 |
| 9,816,223 | B2 * | 11/2017 | Bae | D06F 58/04 |
| 9,822,479 | B2 * | 11/2017 | Bae | D06F 58/28 |
| 10,266,985 | B2 * | 4/2019 | Vaidhyanathan | D06F 58/04 |
| 2003/0010736 | A1 * | 1/2003 | Hope | D06F 58/04 211/133.5 |
| 2007/0119071 | A1 * | 5/2007 | Ackermann | D06F 58/04 34/322 |
| 2017/0233920 | A1 * | 8/2017 | Underly | D06F 29/00 68/17 R |
| 2017/0233921 | A1 * | 8/2017 | Underly | D06F 29/00 68/17 R |
| 2018/0347102 | A1 * | 12/2018 | Um | D06F 58/10 |
| 2019/0003109 | A1 * | 1/2019 | Bailey | D06F 58/22 |
| 2019/0112752 | A1 * | 4/2019 | Dulberg | F26B 21/002 |
| 2019/0117038 | A1 * | 4/2019 | Wilson | A47L 15/46 |
| 2019/0145039 | A1 * | 5/2019 | Underly | D06F 29/00 |

* cited by examiner

STATIONARY RACK ATTACHABLE TO A CLOTHES DRYER

BACKGROUND OF THE INVENTION

Hunters and other outdoorsmen coming in from a wet/cold morning often find themselves in need of a way to quickly dry/warm their boots or shoes before venturing back outside. A device known in the prior art which allows one to dry sneakers and baseball caps—that is, objects with a decidedly lower profile than that of most boots—within a tumble dryer but without their being noisily tossed about in it is taught by Hope in U.S. Pat. No. 6,543,630.

Hope's device includes a drying rack secured, by a pair of spaced apart suction cups, to the interior side of a clothes dryer's door. Extending perpendicularly away from the door is the drying rack's wire frame shelf and a pair of opposing side rails fixedly attached thereto. In the case of a standard clothes dryer with its circular door hinged along one side of the dryer's circular opening, the user is obliged, when attaching the suction cups, to position the drying rack in such a way that the wire frame shelf's end distal from the door can clear the circular opening's edge as the dryer door is being swung shut. Unfortunately, in order to do so, one must limit the spacing between the circular door's horizontal mid-line and the horizontally extending wire frame shelf's end proximate with the door. Otherwise, if the shelf's proximate end were too far above/below the mid-line, the shelf's distal end would fail to clear the circular opening's edge, thus blocking the door's closure. Further complicating this problem of properly positioning the drying rack is the fact that the tops of high profile objects such as boots, especially those stood upright atop the drying rack's wire frame shelf, could, even after the wire frame shelf's distal end itself had been successfully swung clear of the circular opening's edge, still collide with it.

Hope's remedy is to use a dryer with an unusually large, generally rectangularly-shaped opening and a non-circular door that is sized to cover it and hinged to the dryer along one of the opening's two spaced apart, vertical side edges. Indeed, this opening, as shown in U.S. Pat. No. 6,543,630, is so large that it extends across nearly the entire breadth of the dryer itself. Moreover, the dimensions of the wire frame shelf are such that the user, in the process of attaching the drying rack to the door's inside surface with the use of the suction cups, can be assured that the wire frame shelf's distal end will clear that one of the two spaced apart vertical side edges which is widely separated from the door's hinge, provided, during this process, the user basically centers the back wall of the drying rack's wire frame with respect to both of the non-circular door's own spaced apart, vertically extending side edges and at the same time holds the wire frame shelf so that it extends horizontally. Thus, subject to substantially fewer constraints than would exist if the dryer were equipped with a standard circular opening, the user is then free to lower the drying rack until the bottom surface of the wire frame's back wall is brought into such close proximity with the lower edge of the door's inside surface that the distal end of the wire frame's shelf, potentially sagging under the weight of object(s) readied for placement atop this shelf, would not clear the rectangularly-shaped opening's lower edge if the door were to be swung shut. Alternately, the user is free to raise the drying rack until the top surface of the wire frame's back wall is brought into close enough proximity with the upper edge of the door's inside surface that the tops of object(s) being prepared for placement atop this shelf, would collide with the rectangularly-shaped opening's upper edge, as the door was being closed, if such object(s) were to be so placed.

SUMMARY OF THE INVENTION

The object of the present invention is to provide a drying rack easily attachable to, as well as readily removable from, the interior, non-rotating rear wall of a clothes dryer, with the drying rack including a horizontal shelf atop which a pair of boots can be held and retained in an upright standing position at the same time both the drying rack, when it is attached to the dryer's rear wall, and any boots so held are kept out of contact with the dryer's drum.

A further object of the invention is to provide such a drying rack which further includes a pair of side rails, each of which is hingedly connected, along one of the shelf's opposing side edges, to the shelf itself it such a way that the two side rails can be folded towards each other until one of them is not only resting atop the shelf, but also juxtaposed between it and the other side rail, thus forming a compact, generally flat structure with the shelf when the two side rails are so folded.

A still further object of the invention is to provide such a drying rack with side rails so hingedly connected in which the width of the shelf is short enough that the user can easily insert the drying rack with its two side rails so folded through the circular opening of a conventional clothes dryer and, once the drying rack is within the dryer's interior, unfold the two side rails and then attach them to grids on the dryer's rear wall which cover the dryer's air inlet and outlet flow ducts or the like.

In accordance with the present invention, there is provided a drying rack which comprises a rectangularly-shaped wire frame shelf, first and second couplers affixed to the shelf contiguous with its first and second opposing side edges, respectively, and a pair of first and second opposable side rails, each of which includes a base member and an elongated arm oriented perpendicularly thereto, with the first opposable side rail's base member being hingedly connected to at least two spaced apart first couplers at the same time the second opposable side rail's base member is hingedly connected to at least two spaced apart second couplers, and with the first opposable side rail's elongated arm, at its terminal end disposed distally from the first opposable side rail's base member, defining a first hook, and with the second opposable side rail's elongated arm, at its terminal end disposed distally from the second opposable side rail's base member, defining a second hook. Moreover, whenever the first and second opposable side rails have not only been pivoted about their respective base members' hinged connections with the first and second couplers, but also brought into positions in which the first and second opposable side rails generally oppose each other, the first and second hooks are each then generally oriented in a direction away from the shelf, so that the user, utilizing the flexibility afforded by said hinged connections, can quickly suspend the drying rack on the dryer's interior rear wall by simply hooking the first and second elongated arms onto grids or the like located there.

DETAILED DESCRIPTION OF THE PREFERRED EMBODIMENT

Figure 1:
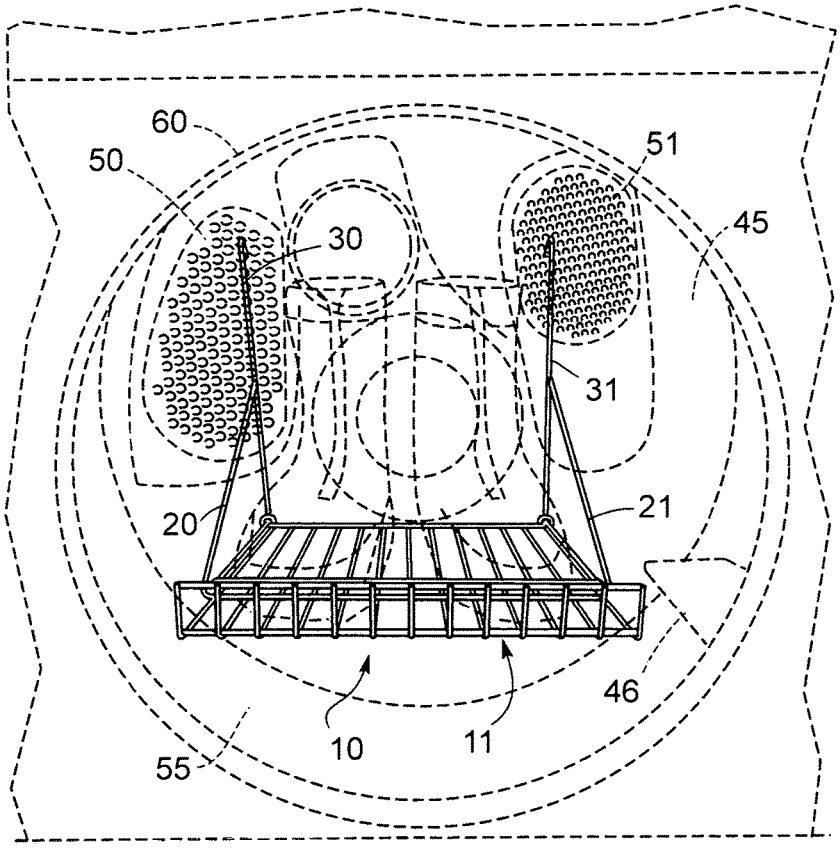
FIG. 1 is a perspective view of the drying rack according to the present invention, with the drying rack, as it holds a pair of high profile boots in an upright position, being shown suspended on a conventional dryer's rear wall from grids located there which cover the dryer's air inlet and outlet flow ducts.

In the drawings and indicated generally by the reference numeral 10 is a drying rack according to the present invention. During use, the drying rack 10, which includes a rectangularly-shaped wire frame shelf 11, hangs from the non-rotating interior rear wall 45 of a standard drum type clothes dryer while the drum 55 rotates and heated air circulates around the stationary, but readily removable drying rack. Supporting the shelf 11 in such a way that it extends generally horizontally away from the rear wall 45 and in the direction of the dryer's opening bounded by circular edge 60 is a pair of hinged, opposable side rails 20, 21, each with its own elongated arm 30, 31, which, prior to use, is hooked onto a grid 50, 51 on the rear wall (FIG. 1).

Moreover, the shelf 11, constructed of multiple stringers 17, 18, 19 which are arrayed in parallel with each other and held in their respective positions by reinforcing bars 12, 13, 14 and 15, is dimensioned not only to allow ample clearance between each of the shelf's opposing side edges—that is, outer stringers 17, 19—and a typical dryer drum 55 with an inwardly projecting plate 46 or the like affixed thereto, but also to hold as many as four boots, each in an upright position atop the shelf's wire frame. In the preferred embodiment, the shelf 11 measures about 10¼ inches in overall width and 16 inches in length—a length which also allows the user to tightly close the dryer's circular door (not shown) so that the dryer can be turned on.

Moreover, as is illustrated in FIG. 1, this embodiment is one in which the shelf 11 is of such a width that it can be held at a height within the dryer which is well below the horizontal midline of the circular edge 60. Otherwise, that portion of the dryer's interior space occupiable by a pair of high profile boots resting atop the shelf 11 could prove to be inadequate in the event the boots needed to be kept in an upright standing position in order to dry them properly.

Figure 4:
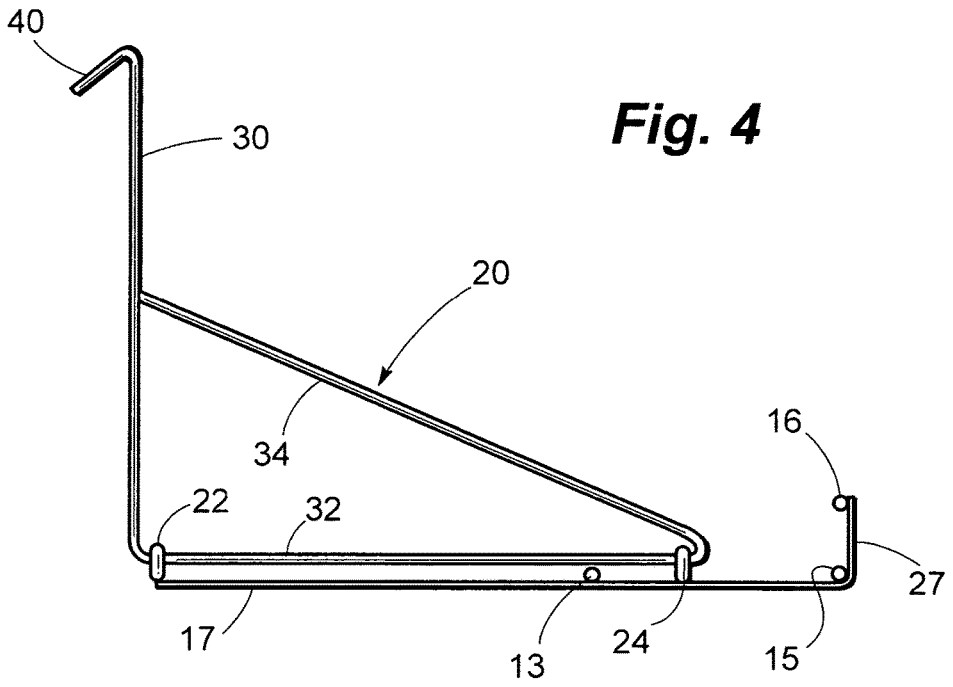
FIG. 4 is a side elevational view of the drying rack according to FIG. 2.

In the preferred embodiment, each opposable side rail 20, 21 is individually formed by bending a metal rod into what is basically—except for the thickness of the rod—a two-dimensional structure in which a handle and a closed loop are integral parts of a single, unitary piece. The general shape of the closed loop is that of a right triangle with interior angles of approximately 23 and 67 degrees, well as the 90 degree right angle; and the handle, for most of its length, is simply a longitudinal extension of the shortest of the generally triangularly-shaped closed loop's three sides (FIG. 4). Nevertheless, this longitudinal extension, at its terminal end distal from the closed loop, defines a hook 40, 41 that is not only oriented in a direction away from the closed loop at the extension's other end, but also the hook is sized to penetrate virtually any one of the openings in the grids 50, 51 present on the dryer's rear wall 45.

Figure 2:
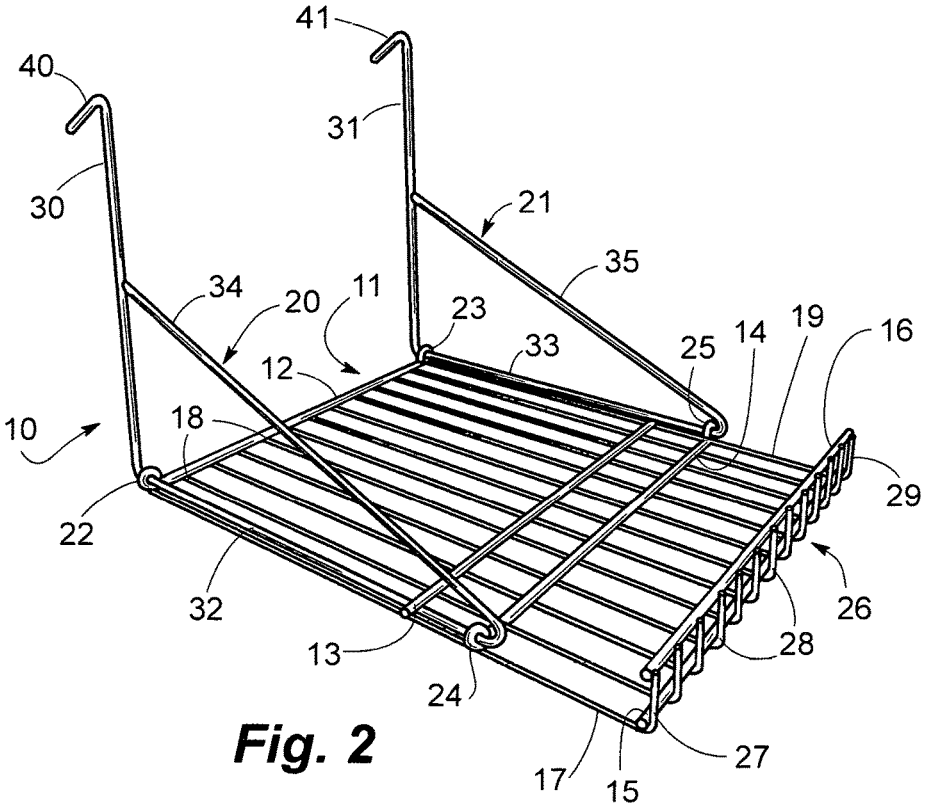
FIG. 2 is a perspective view of the drying rack according to FIG. 1, in which the drying rack is shown with its side rails, hingedly connected to its rectangularly-shaped wire frame shelf, in an unfolded state and, specifically, one wherein the side rails generally oppose each other.
Figure 5:
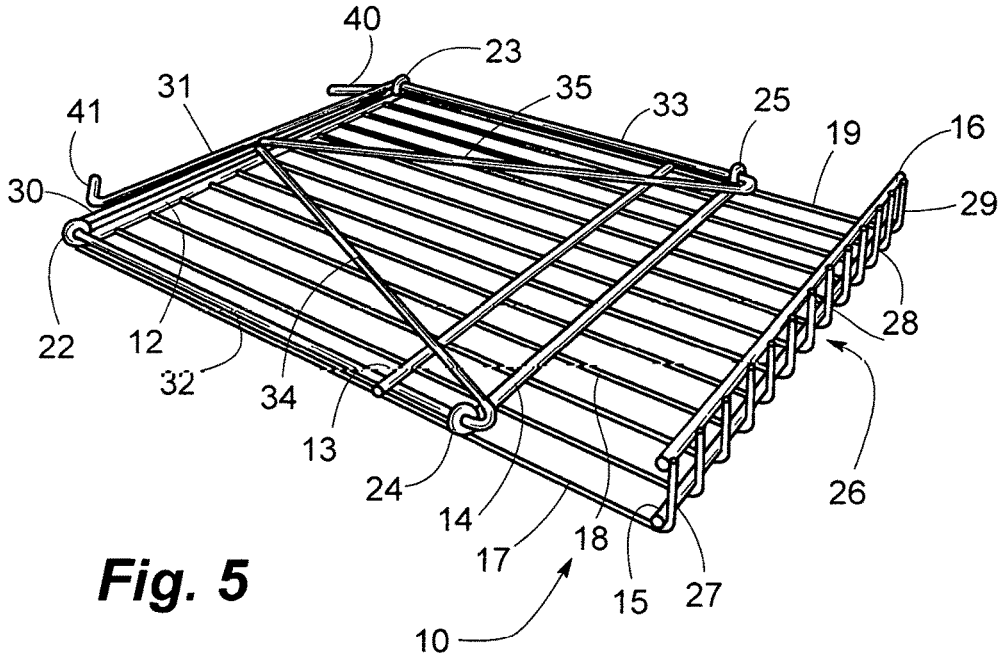
FIG. 5 is a perspective view of the drying rack according to FIG. 1, in which the drying rack is shown with its side rails, hingedly connected to its rectangularly-shaped wire frame shelf, in a folded state and, specifically, one wherein the two side rails have been folded towards each other until, with one of the two side rails partially resting atop the other, the bulk of the drying rack forms a compact, generally flat structure.

Holding the opposable side rails 20, 21 in assembled relation with the wire frame shelf 11 are two pairs of spaced apart, circular-shaped couplers 22, 24 and 23, 25, respectively (FIGS. 2, 4 and 5). Each reinforcing bar 12, 14 terminates at its distal ends in the couplers 22, 23; 24, 25, with the couplers on each reinforcing bar's terminal ends preferably being formed as integral parts of the same single unitary piece as is the reinforcing bar itself. Moreover, like each side rail 20, 21, the reinforcing bar 12 with the couplers 22, 23 on its ends, as well as the reinforcing bar 14 with the couplers 24, 25 on its ends, is preferably formed by bending a metal rod into what is basically—except for the thickness of the rod—a two-dimensional structure. In the preferred embodiment, the metal rods from which the side rails 20, 21 and the reinforcing bars 12, 14 with their respective terminal couplers, as well as the coupler-free reinforcing bars 13, 15, are formed each measure approximately 0.2 inch in diameter, or generally twice each stringer's diameter.

As is best seen in FIGS. 2 and 4, the longitudinal extension of the shortest of the generally triangularly-shaped loop's three sides, like the shortest side itself, is disposed perpendicularly to yet another of the closed loop's three sides—specifically, its base member 32, 33. Importantly, each base member 32, 33, in combination with that pair of spaced apart, circular-shaped couplers 22, 24; 23, 25 located contiguous with the shelf's outer stringers 17, 19, respectively, hingedly connects the side rail 20, 21 to the shelf 11 (FIGS. 2 through 5).

Intersecting the elongated arm 30, 31 and affixed thereto is a brace member 34, 35 (FIGS. 2, 4). The longest side of the generally triangularly-shaped closed loop in which it is found, the brace member 34, 35 connects points on the elongated arm 30, 31, respectively, which are located contiguous with the latter's emergence from said closed loop, with that end of the base member 32, 33, respectively, disposed distally from the closed loop's shortest side. Moreover, each brace member 34, 35 preferably intersects the elongated arm 30, 31 approximately midway between the base member 32, 33 from which the arm extends perpendicularly and the hook 40, 41 at its terminal end (FIG. 4).

Figure 3:
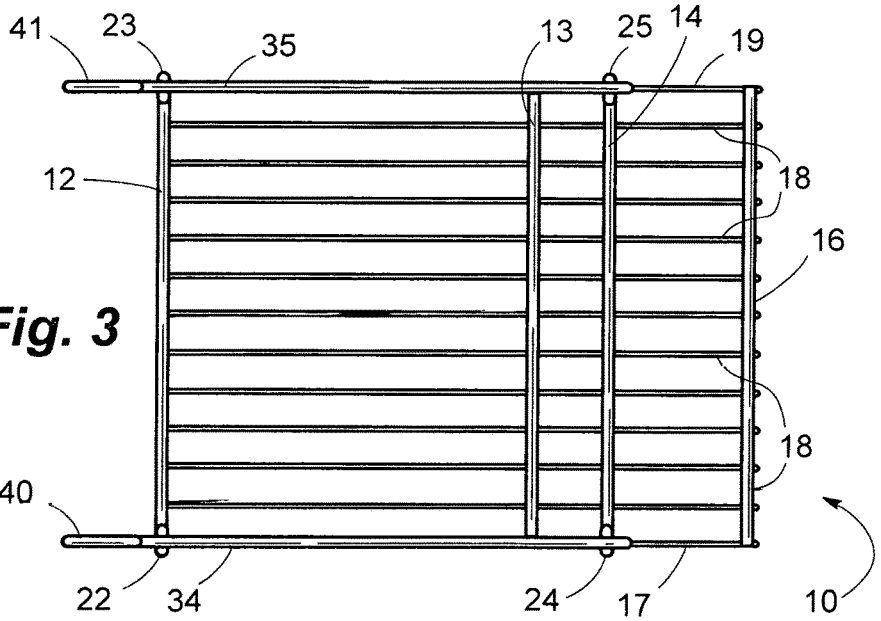
FIG. 3 is a top plan view of the drying rack according to FIG. 2.

Further, in the preferred embodiment, each side rail 20, 21, as well as its brace member 34, 35, spans a distance, in the direction of the base member 32, 33, which is nearly ⅘ths as long as the shelf 11 itself (FIGS. 3 and 4). As a consequence, when the drying rack 10 is hung by the elongated arms 30, 31 on the dryer's rear wall 45, the opposable side rails 20, 21 can resist those gravitational forces acting upon the shelf 11 and upon up to two pairs of heavy, wet boots which may have been placed thereon—forces which, in the presence of the brace members 34, 35, are kept at bay so that the shelf's generally horizontally extended working position can be maintained.

As for the portion of the shelf 11 that extends past the reinforcing bar 14 with its couplers 24, 25, the stringers 17, 18, 19 are not only affixed to the reinforcing bar 15, but also preferably bent around it so as to form an array 26 of short stringer segments 27, 28, 29, respectively (FIGS. 3 and 5). Moreover, the tip of each of these short stringer segments 27, 28, 29 is affixed to one side of a reinforcing bar 16 which is positioned in parallel alignment with the bar 15 and high enough above it that the bar 16, in combination with the short stringer segments, can act as a shallow barrier, adequate as a guide to help the user properly position boots or the like on the shelf 11 (FIGS. 1, 2).

The invention claimed is:

1. A drying rack for boots and similar objects that is adapted for use with a clothes dryer having a rotatable drum, an interior rear wall that remains generally stationary as the drum is being rotated, and spaced apart grids, located on the interior rear wall, that cover the dryer's air inlet and outlet flow ducts, which comprises:

(a) a generally rectangularly-shaped shelf having a wire frame structure with at least one pair of first and second opposing side edges;

(b) first and second opposable side rails, each of which includes a base member and an elongated arm oriented perpendicularly thereto which are integral parts of a generally two-dimensional piece;

(c) means for hingedly connecting the first opposable side rail's base member to the shelf proximate with said pair's first opposing side edge and generally in parallel alignment therewith;

(d) means for hingedly connecting the second opposable side rail's base member to the shelf proximate with said pair's second opposing side edge and generally in parallel alignment therewith;

(e) wherein the first opposable side rail's elongated arm, at its terminal end disposed distally from the first opposable side rail's base member, defines a first hook which is generally oriented in a direction away from the first opposable side rail's base member; and (f) wherein the second opposable side rail's elongated arm, at its terminal end disposed distally from the second opposable side rail's base member, defines a second hook which is generally oriented in a direction away from the second opposable side rail's base member, so that the user, by causing the first and second hooks to penetrate the rear wall's grids at sites thereon which are spaced apart generally horizontally from each other and separated by a distance generally as long as the spacing between said pair's first and second opposing side edges, can suspend the drying rack, with its shelf extending generally horizontally, from the dryer's interior rear wall.

2. The drying rack according to claim 1, which further comprises first and second brace members, wherein the first brace member has a substantially greater length than does the first opposable side rail's base member, and the second brace member is substantially longer than the second opposable side rail's base member; wherein the first brace member, the first opposable side rail's base member, and a portion of the first opposable side rail's elongated arm form a first generally triangularly-shaped closed loop's three sides, with the first brace member intersecting the first opposable side rail's elongated arm proximate with its midsection; and wherein the second brace member, the second opposable side rail's base member, and a portion of the second opposable side rail's elongated arm form a second generally triangularly-shaped closed loop's three sides, with the second brace member intersecting the second opposable side rail's elongated arm proximate with its midsection.

3. The drying rack according to claim 1, which further comprises first and second couplers affixed to the shelf contiguous with said pair's first and second opposing side edges, respectively, wherein the first opposable side rail's base member is hingedly connected to at least two spaced apart first couplers at the same time the second opposable side rail's base member is hingedly connected to at least two spaced apart second couplers, wherein each first coupler defines a generally circular-shaped loop which is affixed to the shelf and protrudes upwardly therefrom, with the first opposable side rail's base member, in assembled relation with the first couplers, being longitudinally aligned with each first coupler's circular-shaped loop-defined through centerline, and wherein each second coupler defines a generally circular-shaped loop which is affixed to the shelf and protrudes upwardly therefrom, with the second opposable side rail's base member, in assembled relation with the second couplers, being longitudinally aligned with each second coupler's circular-shaped loop-defined through centerline, so that the first and second opposable side rails can be folded towards each other until one of them, as it rests atop the shelf, is juxtaposed between the shelf and the other opposable side rail, thus forming a compact, generally flat construct with the shelf when the first and second opposable side rails are so folded.

4. The drying rack according to claim 3, wherein each of the first and second opposable side rails' elongated arms is nearly as long as the spacing between said pair's first and second opposing side edges.

5. The drying rack according to claim 3, wherein the generally circular-shaped loop of one of the spaced apart first couplers is further characterized as protruding upwardly from the shelf contiguous with a terminal end of said pair's first opposing side edge, and wherein the generally circular-shaped loop of one of the spaced apart second couplers is further characterized as protruding upwardly from the shelf contiguous with a terminal end of said pair's second opposing side edge, with the first and second opposable side rails' base members being hingedly connected to the first and second couplers, respectively, in such a way that the first opposable side rail's base member extends past the first opposing side edge's terminal end and the second opposable side rail's base member extends past the second opposing side edge's terminal end, thus positioning the first and second opposable side rails' elongated arms rearwardly of the shelf, so that, during use, the shelf's weight and that of any objects supported thereon keep each of said arms, for substantially its entire length, in direct contact with the dryer's rear wall.

6. A drying rack for boots and similar objects that is adapted for use with a clothes dryer having a rotatable drum, an interior rear wall that remains generally stationary as the drum is being rotated, and spaced apart grids, located on the interior rear wall, that cover the dryer's air inlet and outlet flow ducts, which comprises:

(a) a generally rectangularly-shaped shelf;

(b) first and second opposable side rails, each which includes a base member and an elongated arm oriented perpendicularly thereto;

(c) means for hingedly connecting the first opposable side rail's base member to the shelf in general parallel alignment with the shelf's longitudinal centerline and spaced apart from it on one side thereof;

(d) means for hingedly connecting the second opposable side rail's base member to the shelf in general parallel alignment with the shelf's longitudinal centerline and spaced apart from the first opposable side rail's base member by approximately twice the spacing between it and the shelf's longitudinal centerline, as well as on the other side thereof;

(e) wherein the first opposable side rail's elongated arm, at its terminal end disposed distally from the first opposable side rail's base member, defines a first hook which is generally oriented in a direction away from the first opposable side rail's base member; and (f) wherein the second opposable side rail's elongated arm, at its terminal end disposed distally from the second opposable side rail's base member, defines a second hook which is generally oriented in a direction away from the second opposable side rail's base member, so that the user, by causing the first and second hooks to penetrate the rear wall's grids at sites thereon which are spaced apart generally horizontally from each other and separated by a distance generally as long as twice the spacing between the first opposable side rail's base member and the shelf's longitudinal centerline, can suspend the drying rack, with its shelf extending generally horizontally, from the dryer's interior rear wall.

7. A drying rack for boots and similar objects that is adapted for use with a clothes dryer having a rotatable drum, and at least one pair of spaced apart holes, each of which measures approximately 0.25 inch in diameter and has been drilled into the dryer's rear wall at a site thereon located upwardly of the dryer drum's through centerline by a distance which is at least one-half of the spacing which separates the pair's spaced apart holes, with each of them being positioned, by about the width of an adult boot's toe box, generally equidistant from an imaginary plane which bisects the dryer drum vertically, which comprises:

(a) a generally rectangularly-shaped shelf;

(b) first and second opposable side rails, each of which includes a base member and an elongated arm oriented perpendicularly thereto;

(c) means for hingedly connecting the first opposable side rail's base member to the shelf in general parallel alignment with the shelf's longitudinal centerline and spaced apart from it on one side thereof;

(d) means for hingedly connecting the second opposable side rail's base member to the shelf in general parallel alignment with the shelf's longitudinal centerline and spaced apart from the first opposable side rail's base member by approximately twice the spacing between it and the shelf's longitudinal centerline, as well as on the other side thereof;

(e) wherein the first opposable side rail's elongated arm, at its terminal end disposed distally from the first opposable side rail's base member, defines a first hook which is generally oriented in a direction away from the first opposable side rail's base member; and (f) wherein the second opposable side rail's elongated arm, arm, at its terminal end disposed distally from the second opposable side rail's base member, defines a second hook which is generally oriented in a direction away from the second opposable side rail's base member, with each of the first and second hooks measuring at most approximately 0.2 inch in transverse cross-section, so that user, by causing the first hook to penetrate one of said pair of spaced apart holes drilled into the dryer's rear wall at the same time the second hook penetrates the other hole of said pair, can suspend the drying rack, with its shelf extending generally horizontally, from the dryer's interior rear wall.

* * * * *